United States Patent [19]

Fields et al.

[11] Patent Number: 4,526,621

[45] Date of Patent: Jul. 2, 1985

[54] PORTABLE FACILITY FOR PROCESSING GRANULATED SUGAR INTO LIQUID SUCROSE AND INVERT SUGAR

[75] Inventors: Melvin C. Fields, Muncie; Paul F. Fields, Parker City, both of Ind.

[73] Assignee: Process Supply Company, Inc., Muncie, Ind.

[21] Appl. No.: 529,356

[22] Filed: Sep. 6, 1983

[51] Int. Cl.[3] ..... C13K 1/00

[52] U.S. Cl. ..... 127/1; 127/2; 127/22

[58] Field of Search ..... 127/1, 2, 22; 210/241

[56] References Cited

U.S. PATENT DOCUMENTS

| | | | |
|---|---|---|---|
| 3,480,476 | 11/1969 | Abbott | 127/1 |
| 3,901,724 | 8/1975 | White | 127/22 |
| 3,939,005 | 2/1976 | White | 127/22 |
| 4,046,689 | 9/1977 | Argyll | 210/241 |
| 4,153,553 | 5/1979 | Davis | 210/241 |
| 4,308,139 | 12/1981 | Piepho | 210/241 |
| 4,360,436 | 11/1982 | Poveromo | 210/241 |

*Primary Examiner*—Marc L. Caroff
*Assistant Examiner*—W. Gary Jones
*Attorney, Agent, or Firm*—Woodard, Weikart, Emhardt & Naughton

[57] ABSTRACT

A sugar processing facility, including a boiler, a mixing tank, and an interconnecting assemblage of pumps, motors, control valves and liquid conduits, for commercially processing granulated sugar into either sucrose or invert sugar. The sugar processing facility is sized for integration into the production processes of commercial beverage bottling facilities and is operable on an unimproved site adjacent such facilities. The facility is mounted upon a standard sized flat bed trailer, thereby permitting it to be transported as a fully assembled and operable unit by standard rail, ocean freight, and road transportation methods to a desired processing location without having to first at least partially disassemble or otherwise specially adapt the facility for transportation.

4 Claims, 3 Drawing Figures

PORTABLE FACILITY FOR PROCESSING GRANULATED SUGAR INTO LIQUID SUCROSE AND INVERT SUGAR

BACKGROUND OF THE INVENTION

The subject invention relates generally to the field of sugar processing facilities which are capable of commercially processing granulated sugar into liquid sucrose or invert sugar and, more particularly, to those facilities which are suited for integration into the production process of commercial beverage bottling facilities.

In the United States and other highly industrialized countries, carbonated beverage bottlers frequently process granulated sugar into either liquid sucrose, which is a sugar solution in water containing 67.3 to 67.7% sugar by weight, or 50% invert sugar, which is a liquid sugar mixture in which half of the sucrose has been hydrolized into glucose and fructose. The liquid sucrose or invert sugar is then stored in suitable storage tanks and pumped into vats where the beverage is mixed in batches prior to bottling.

In areas where the population base is relatively small and the economy is not highly industrialized, equipment for such facilities must be shipped considerable distances for assembly on site. If the capacity of the bottling plant is to be relatively small, it is not uncommon for the bottler to opt against incorporating equipment for making liquid sucrose and invert sugar into the overall bottling process. Thus, in such situations the bottler mixes granulated sugar directly into the beverage mix on a batch by batch basis. While this practice avoids the need for equipment to process granulated sugar into liquid sucrose or invert sugar, there are inherent disadvantages. Mixing granulated sugar directly into the batch means that considerable handling is required, which is expensive in terms of the extra labor involved. This method is also less accurate than metering liquid sugar, resulting in greater variance in product quality. Further, dust particles or other contaminants are more of a problem when granulated sugar is used, not to mention storing problems due to rodents, etc.

SUMMARY OF THE INVENTION

A sugar processing facility, according to one embodiment of the present invention comprises means, including a boiler, a mixing tank, and an interconnecting assemblage of pumps, motors, control valves and liquid conduits, for commercially processing granulated sugar into either sucrose or invert sugar. The processing means is sized for integration into the production processes of commercial beverage bottling facilities. There is further provided means for transporting said processing means by standard rail, ocean freight, and road transportation methods, as a fully assembled and operable unit, to a desired processing location without having to first at least partially disassemble or otherwise specially adapt the processing means for transportation. The transporting means further permits operation of the facility on an unimproved site.

Because of the disadvantages associated with using granulated sugar, there are distinct advantages for beverage bottles using granulated sugar to switch to either sucrose or invert sugar. The present invention affords several improvements. The arrangement of the boiler, mixing tank and associated pumps and valves is new, as is the routing of the water and slurry between the boiler and mixing tank. Also, the arrangement of the power and water feed lines as the granulated sugar input is new, being conveniently positioned for access from external locations. Further, the mounting of the facility for transportation by standard methods as a fully assembled operable unit affords additional advantages to bottlers in geographical locations which render previous facilities impracticable.

It is an object of the present invention to provide an improved sugar processing facility.

Related objects and advantages of the present invention will be made more apparent by reference to the following figures and detailed description.

DESCRIPTION OF THE PREFERRED EMBODIMENT

Figure 1:
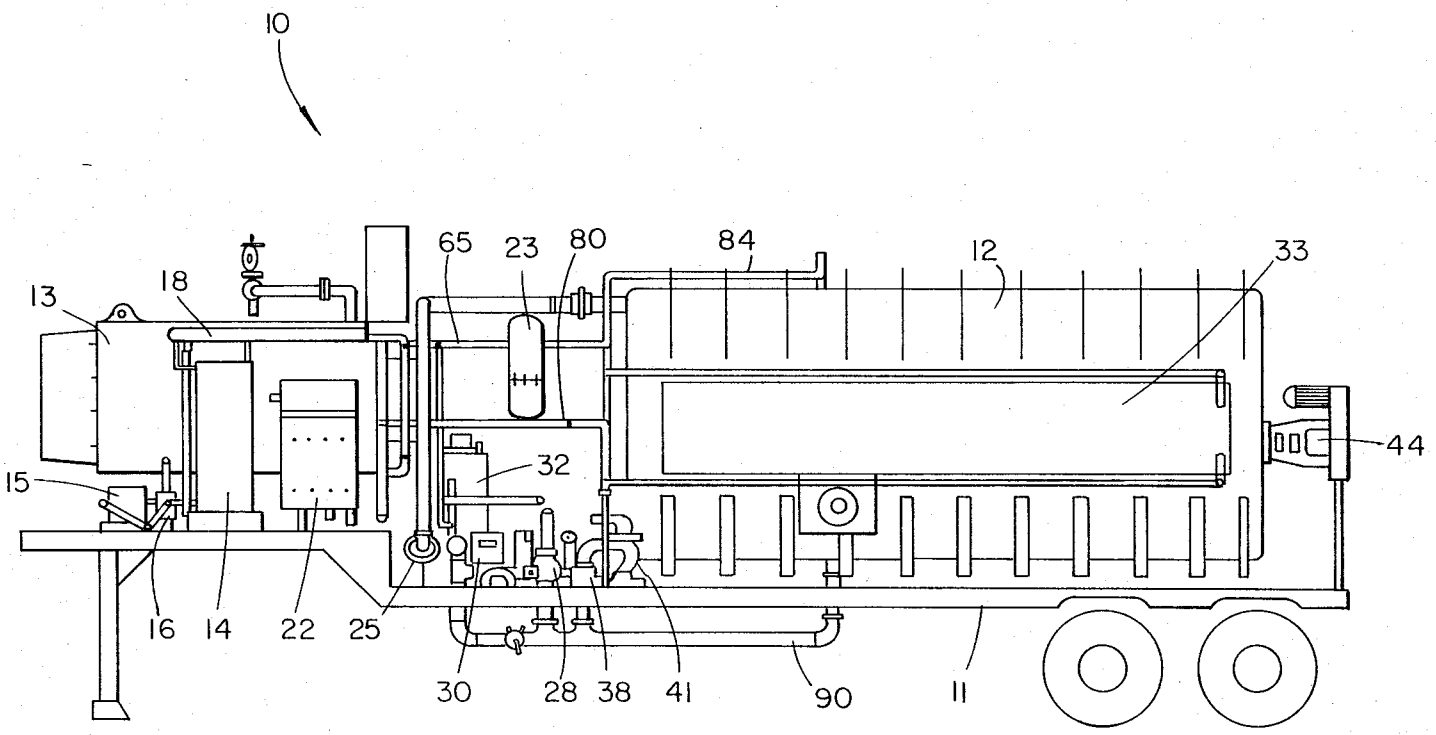
FIG. 1 is an elevation view of the portable sugar processing facility of the present invention.
Figure 2:
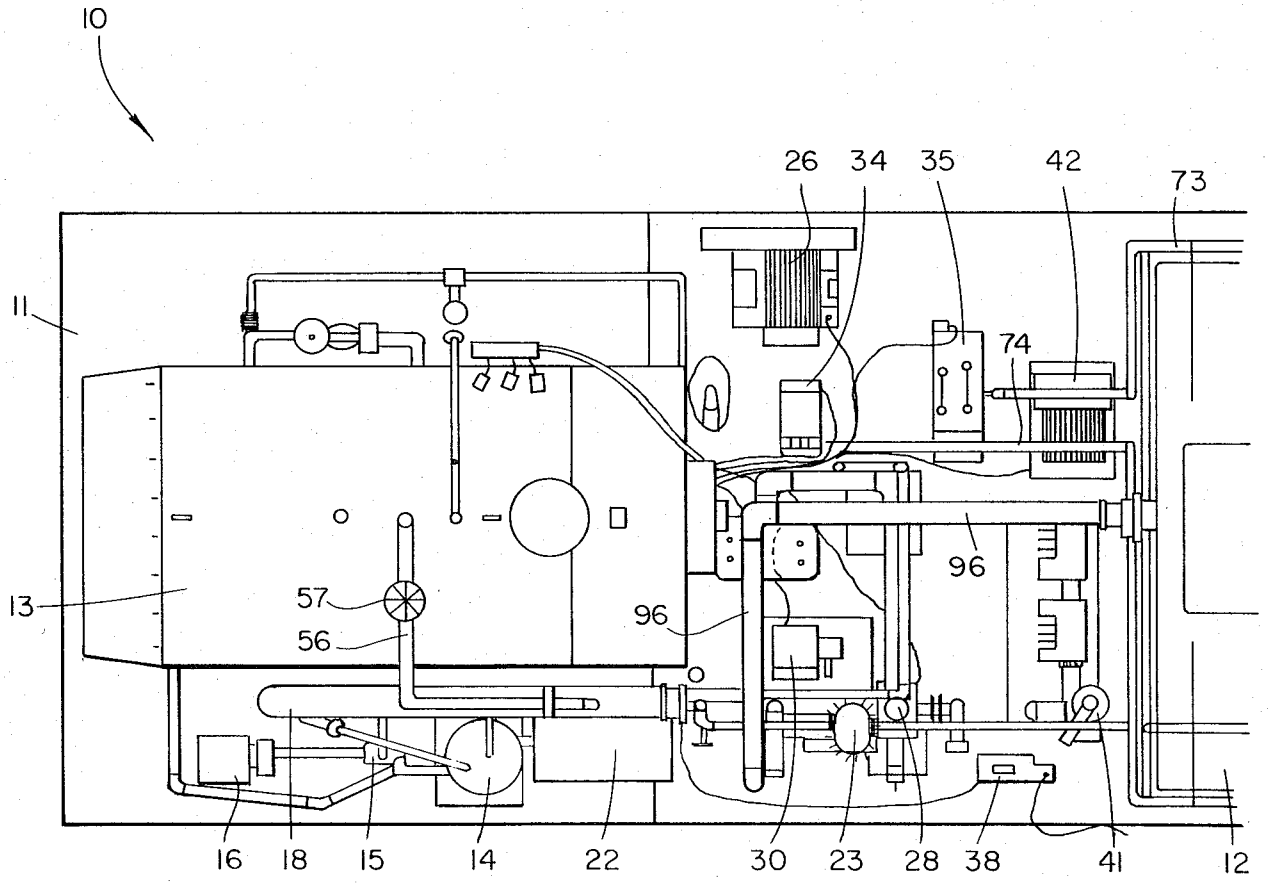
FIG. 2 is a fragmentary top view of the portable sugar processing facility shown in FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, there is shown a facility for processing granulated sugar into either sucrose (a solution of sucrose in water containing 67.3–67.7% sucrose by weight) or 50% invert sugar (a solution of sucrose in water in which half the sucrose is hydrolized into fructose and glucose) generally designated at 10 mounted upon a standard 42′ long flatbed trailer 11. Facility 10 includes a generally rectangular shaped process tank 12 having a 10,800 gallon capacity mounted lengthwise on trailer 11 in tandem behind a boiler 13. Boiler 13 is a 70 h.p. boiler and is manufactured by Superior Combustion Industries. Inc. of Emmaus, Pa. under model number N4G60A. A stainless steel feed tank 14 is mounted on trailer 11 adjacent one side of boiler 13. Pump 15 and motor 16 are mounted to trailer 11 immediately forward of feed tank 14 and provide a means for automatically supplying water from feed tank 14 in order to maintain the water supply in boiler 13. Pump 15 is a Viking pump model number 11JG25 produced by Sparkler Mfg. Company of Mundelein, Ill., while motor 16 is a 1½ h.p. motor produced by General Electric Corp. under model number 5K204E7. Heat exchanger 18 is horizontally mounted above feed tank 14 and is supported by two vertical supports 20 and 21 which are in turn fixedly mounted to trailer 11 at their respective lower ends. Heat exchanger 18 provides heat exchange between boiler 13 and an external water supply. Heat exchanger 18 is produced by Bell & Gossett Products of Chicago, Ill. under model number SU-66-4. Main electric panel 22 is mounted to trailer 11 adjacent feed tank 14 and immediately below heat exchanger 18. When connected to an external electric power supply, panel 22 serves to control the distribution of 100 ampere, 230 volt, 3 phase electric current for boiler 13, pump motors and for other electrical devices. Filter 23 is positioned at approximately the same height as heat exchanger 13 between boiler 13 and process tank 12 and serves to filter water entering process tank 12 from heat exchanger 18. Filter 23 is produced by Dolinger, Inc. of Rochester, N.Y. under model number GP-111-345. Below filter 23 several pumps are mounted directly upon trailer 11. Pump 25 serves to pump a slurry of granulated sugar in water from a rail car or bag hopper into process tank 12. Pump 25 is driven by a 10 h.p. motor 26 mounted on the other side of trailer 11. Pump 25 is produced by Siemens-Allis, Inc. of Little Rock, Ark., while motor 26 is produced by Tidewater Supply, Inc. of Norfolk, Va. under model number 629. Pump 28 serves to pump finished product into or out of process tank 12 in a manner which will be described later herein. Pump 28 is driven by a 7½ h.p. motor 29. Pump 28 is a Type 1 pump produced by Roper Pump Co. of Commerce, Ga., while motor 29 is produced by General Motors Corp., Delco Products Division, of Dayton, Ohio under model number B-849. Meter 30 is mounted between pumps 25 and 28 and serves to measure the gallon amount of finished product pumped into or out of process tank 12. Meter 30 includes a ticket printer for printing this information on a load ticket. Meter 30 is a 3" liquid flow measurement meter produced by Liquid Controls Corporation of Chicago, Ill. under model number M15.

Filter 32 is centrally mounted on trailer 11 behind boiler 13 and is used to filter the finished product as it is being pumped into or out of process tank 12. Filter 32 is an FSI twin micron filter produced by Filter Specialist, Inc. of Michigan City, Ind. under model number FS-102. Adjacent filter 32 and motor 29 are two motor actuated pumps 34 and 35 which are used to circulate hot water from heat exchanger 18 through heat panels 33 located on either side of process tank 12. Pumps 34 and 35 are produced by Allis Charlmers Corp., Industrial Pump Division of Cincinnati, Ohio under model numbers 9E37JY2300 and 5K43AC2114, respectively, and the motors therefor are ¼ h.p. motors. A motor driven pump 38 is mounted on trailer 11 adjacent pump 28 and is used to pump acid or caustic into process tank 12 for a purpose which will become fully apparent hereinafter. Pump 38 is a Flex-I-Liner pump produced by Vanton Pump & Equipment Corporation of Hillside, N.J. under model number CC-PY18B, and the motor attached to the pump is a ¼ h.p. motor produced by Baldor Electric Company of Fort Smith, Ark. Mounted on trailer 11 adjacent pump 38 is a pump 41 driven by motor 42. Pump 41 serves to circulate the product from process tank 12 back to the railcar or bag hopper during processing. Pump 41 is produced by Houdaille Industries Inc., Viking Pump Division, of Cedar Falls, Iowa under model number K124, while motor 42 is a 5 h.p. motor produced by General Electric Corp. Agitator 44 is mounted at the rearmost portion of trailer 11 and extends sealingly within process tank 12 to provide agitation of the mixture inside process tank 12 during processing. Agitator 44 is a Lightnin Mixer model number 108-VSE-2 produced by Mixing Equipment Company Inc. of Rochester, N.Y., and is driven by a 2 h.p. motor produced by Allis-Chalmers Corp. of Norwood, Ohio under model number 511.

Figure 3:
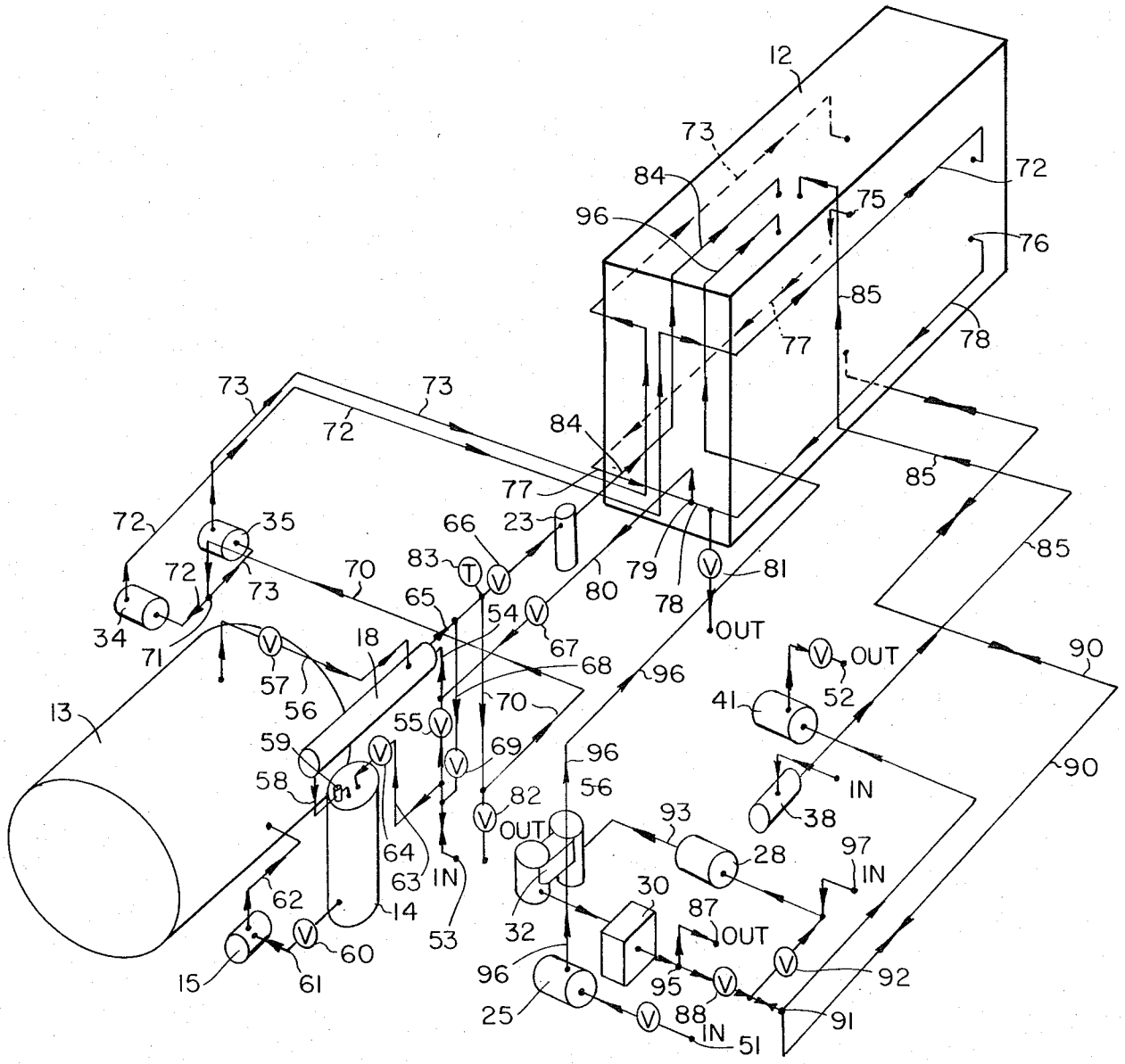
FIG. 3 is a schematic representation of the various pipe lines, valves, pumps and tanks of the apparatus of FIG. 1 showing the directions of fluid flow therethrough.

FIG. 3 is a schematic diagram illustrating the flow connections among the various elements described above. In order to make liquid sucrose or invert, a 12 gauge stainless steel liquifying pan (not shown) is first fastened to a bulk railcar or bag hopper. A 4" diameter hose is then connected between the pan and inlet 51 of pump 25, a 2" diameter hose is connected between the pan and outlet 52 of pump 41, and inlet 53 is connected by a 2" diameter hose to a suitable external water supply.

Once these connections have been made, the next step involves filling process tank 12 with an amount of hot water which is equal to that amount of water which is needed to produce the desired amount of finished product. For example, in order to produce a 4000 gallon batch of liquid sucrose, 1600 gallons of water is required along with 30,000 lbs. of granulated sugar. It is, of course, understood that the volume of water provided is an approximation and serves as a starting point only, a Brix reading being required to determine whether the desired percentage by weight of sucrose in solution has been attained.

In order to provide hot water to process tank 12 cold water is circulated into heat exchanger 18 through line 54 by opening valve 55. Steam from boiler 13 is sent to heat exchanger 18 through line 56 by opening valve 57 and, after heating the cold water circulating through heat exchanger 18, the steam condenses and exits the heat exchanger through line 58 which routes the condensate through trap 59 back to feed tank 14. As mentioned earlier, the water level in boiler 13 is maintained by opening valve 60 and pumping water from feed tank 14 through lines 61 and 62 via pump 15, the level of water in feed tank 14 being maintained through line 63 by opening valve 64. Process water entering heat exchanger 18 through inlet line 54 exits therefrom through outlet line 65 and is recirculated to the heat exchanger by closing valve 66, opening valve 67 and activating pumps 34 and 35. Line 68 through valve 69 is also closed, its only purpose being as a utility line for supplying hot water from heat exchanger 18. The process water circulates through line 70 to T-coupling 71, whereupon it is pumped by pumps 34 and 35 along lines 72 and 73, respectively, to heating panels 26 located on either side of process tank 12. In addition to maintaining the temperature of the process water in tank 12, heat panels 33 also permit pasteurization of the finished product in tank 12 prior to transfer to storage tanks. The process water exits panels 26 at outlets 75 and 76 and is routed along lines 77 and 78 to T-coupling 79. Return line 80 is connected to the outlet of T-coupling 79 and recirculates the process water through valve 67 back to heat exchanger 18. Valves 81 and 82 serve as a means of draining the water from the water lines associated therewith. Temperature gage 83 serves as a means of gaging the temperature of the process water exiting heat exchanger 18.

When the process water has reached a desired temperature, valve 66 is opened and the process water is filtered through filter 23 and sent to process tank 12 through line 65. Once process tank 12 is filled with hot water from heat exchanger 18, the valves on the 2" hose between pump 41 and the liquifying pan and on the 4" hose between pump 25 and the liquifying pan are opened, and pumps 25 and 41 activated. This causes hot water to enter the liquifying pan, melt the granulated sugar and circulate a slurry of sugar and water into process tank 12 through line 95. During this process, agitator 16 serves to agitate the product to assist in its blending in the process tank. The process is continued until the proper sugar content is achieved. A pH reading is also taken to determine whether the pH level of the product is within an acceptable range of 7.0±0.5. If the pH needs to be increased, pump 38 is used to pump rayon grade caustic soda into process tank 12 through line 85. If the pH needs to be lowered, reagent grade muriatic acid is pumped into process tank via pump 38.

In order to produce invert sugar, a similar procedure is followed, except that the liquid surcrose is made acidic by the addition of hydrochloric acid and the temperature is increased so as to hydrolyze the surcrose into glucose and fructose. The higher the temperature and the lower the pH, the faster the inversion reaction proceeds. A 100% invert sugar solution would be one where all the sucrose has been hydrolyzed into glucose and fructose, however, typically only a 50% invert product is desired. The percent inversion multiplied by a factor of 0.022 gives the De Waalic factor, which is the amount the Brix needs to be raised to attain the final desired Brix. Thus, in order to attain a Brix of 76.6 for a 50% invert final product, it is necessary for the liquid sucrose to have a Brix of approximately 75.5 after inversion. The process for making a 50% invert product having a Brix of 75.0 is described as follows. Processing the granulated sugar into liquid sucrose takes place in the manner previously described, except that the process continues until the Brix reaches a level of 74.5 to 75.0. Once the temperature of the liquid sucrose reaches 165° F., hydrochloric acid is added to the liquid sucrose in process tank 12 via pump 38 to lower the pH of the liquid sucrose. Agitator 16 is employed to maintain constant agitation of the product during the inversion process. At a temperature of 165° F. the inversion process will take approximately 25–30 minutes, at which time caustic soda is added into process tank 12 through pump 38 in order to raise the pH and stop the inversion process. After allowing approximately 10 minutes for mixing of the caustic soda in tank 12, a pH sample is taken. If the pH has not been raised to a level of 5.0±0.5, additional caustic soda is added until the desired pH level is achieved. Finally, a Brix reading is taken of the product using conventional means, such as a refractometer, and percent inversion is also determined using conventional means, such as a polarimeter. After the liquid sucrose or invert sugar has been determined to have acceptable Brix and pH levels, the product is pasteurized by circulating hot water through heating panels 26 in a manner previously described.

After processing and pasteurization, the product may be pumped into a storage tanker through a 3" diameter hose connected to outlet 87 by closing valve 88 and opening valve 92 and activating pump 28. The product exits process tank 12 through line 90 and is routed through T-coupling 91 and valve 92 to pump 28. The product then exits pump 28 through line 93 and passes through filter 32, meter 30 and T-coupling 95 before exiting outlet 87. Process tank 12 may also be used as a storage tank, in which case finished product may be pumped into tank 12 through inlet 97 using pump 28 with valve 88 opened, valve 92 closed, and outlet 87 capped.

It is to be appreciated that each of the inlet/outlets previously referred to above is conveniently located such that they are easily accessed from a position external of apparatus 10. Further, apparatus 10 may be transported to a desired location as a pre-assembled unit without having to resort to specialized modes of transportation such as are required by oversized loads. For example, apparatus 10 can be easily transported on a standard sized flatbed railcar, by a standard tractor used for conventional tractor/trailers without exceeding typical highway load width limitations, or in standard sized package cargo containers used to transport freight in cargo vessels. Thus, transportation and assembly costs are significantly reduced, an obvious advantage to the user.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A mobile sugar processing facility, comprising:

a flatbed trailer;

a process tank mounted in said flatbed trailer, said process tank including heat panels positioned on opposite sides of said process tank;

a boiler mounted on said flatbed trailer in tandem ahead of said process tank;

a boiler feed tank mounted on one side of said boiler in fluid communication therewith;

a heat exchanger mounted above said boiler feed tank and operably connected to said boiler and an external water supply so as to provide heat exchange therebetween;

a water filter mounted at substantially the same height as said heat exchanger and between said boiler and said process tank, said water filter operably connected to said process tank and said heat exchanger in order to filter water entering said process tank from said heat exchanger;

a first pump mounted between said boiler and said process tank and operably connected to said process tank and an external source of a slurry of granulated sugar in order to pump said slurry into said process tank;

a second pump mounted between said boiler and said process tank;

a conduit means connected between said process tank and said second pump, said conduit means extending substantially along the underside of said flatbed trailer, said second pump operable to pump finished product from said process tank;

a third pump means mounted between said boiler and said process tank and operably connected to said heat exchanger and said heat panels on said process tank in order to provide circulation of hot water from said heat exchanger to said heat panels.

2. The apparatus of claim 1 and further comprising: a second filter mounted between said boiler and said process tank and operably connected to said second pump in order to provide filtering of the finished product exiting said process tank.

3. The apparatus of claim 1 and further comprising: a meter mounted between said boiler and said process tank and operably connected to said second pump in order to provide metering of the volume of finished product exiting said process tank.

4. The apparatus of claim 1 and further comprising: a fourth pump mounted between said boiler and said process tank and operably connected to said process tank to provide for the introduction of acid or caustic into said process tank.

* * * * *